US005923242A

United States Patent [19]

Slagle et al.

[11] Patent Number: 5,923,242

[45] Date of Patent: Jul. 13, 1999

[54] PRIZE ANNOUNCEMENT ASSEMBLY AND ITS MANUFACTURE

[75] Inventors: Jonathan C. Slagle, Plymouth; Curtis J. Deering, Maple Grove, both of Minn.

[73] Assignee: General Mills, Inc., Minneapolis, Minn.

[21] Appl. No.: 08/861,042

[22] Filed: May 21, 1997

[51] Int. Cl.[6] ..... G08B 3/00

[52] U.S. Cl. ..... 340/328; 340/693.5; 340/384.1; 340/384.7

[58] Field of Search ..... 340/328, 321, 340/384.1, 384.7, 691, 555, 556, 693.5, 692, 568; 434/317

[56] References Cited

U.S. PATENT DOCUMENTS

| | | | |
|---|---|---|---|
| 3,808,707 | 5/1974 | Fink | 35/29 A |
| 4,222,188 | 9/1980 | Tarrant et al. | 40/152.1 |
| 4,541,028 | 9/1985 | Johnson | 360/137 |
| 4,541,188 | 9/1985 | Sadorus | 40/152.1 |
| 4,541,805 | 9/1985 | Weaver et al. | 434/95 |
| 4,639,225 | 1/1987 | Washizuka | 434/308 |
| 4,651,613 | 3/1987 | Harrison | 434/311 |
| 4,692,748 | 9/1987 | Pinsak et al. | 340/573 |
| 4,714,914 | 12/1987 | Boe | 340/573 |
| 4,732,072 | 3/1988 | Garlock | 84/470 R |
| 4,796,658 | 1/1989 | Caple | 137/312 |
| 4,801,929 | 1/1989 | Instance | 340/692 |
| 4,856,213 | 8/1989 | Hord | 40/152 |
| 4,866,865 | 9/1989 | Yang | 40/455 |
| 4,911,320 | 3/1990 | Howes | 220/20 |
| 4,934,079 | 6/1990 | Hoshi | 40/427 |
| 4,936,780 | 6/1990 | Cogliano | 434/311 |
| 5,056,659 | 10/1991 | Howes et al. | 206/217 |
| 5,056,681 | 10/1991 | Howes | 220/522 |
| 5,063,698 | 11/1991 | Johnson et al. | 40/124.1 |
| 5,075,970 | 12/1991 | Albert | 30/123 |
| 5,076,433 | 12/1991 | Howes | 206/459 |
| 5,099,232 | 3/1992 | Howes | 340/815.21 |
| 5,189,793 | 3/1993 | Ratzon et al. | 30/123 |
| 5,283,567 | 2/1994 | Howes | 340/815.69 |
| 5,478,267 | 12/1995 | McDonald et al. | 446/15 |

*Primary Examiner*—Jeffery A. Hofsass
*Assistant Examiner*—Anh La
*Attorney, Agent, or Firm*—John A. O'Toole; Alan D. Kamrath

[57] ABSTRACT

A light-activated, sound-providing device (22) is secured to the upper surface of a mounting board (12) by a film formed of translucent material (26) thereby sealing the sound-providing device (22) therebetween. The sound-providing device (22) is mounted spaced from the longitudinal end of the mounting board (12) which is inserted between the bag (38) and the package (16) so that the sound-providing device (22) is positioned adjacent the top of the bag (38). In a preferred form, the sound-providing device (22) is not activated while in the interior of a closed package (16) but when the package (16) is opened, the sound-providing device (22) is activated providing a sound for prize announcement, attention getting, or a similar function. A removable, opaque label (34) is positioned on the translucent material (26) over the sound-providing device (22) to prevent light from activating the sound-providing device (22) during handling and manipulation of the sound-providing assembly (10) and in the preferred form is removed prior to its placement and sealing in the package (16).

19 Claims, 2 Drawing Sheets

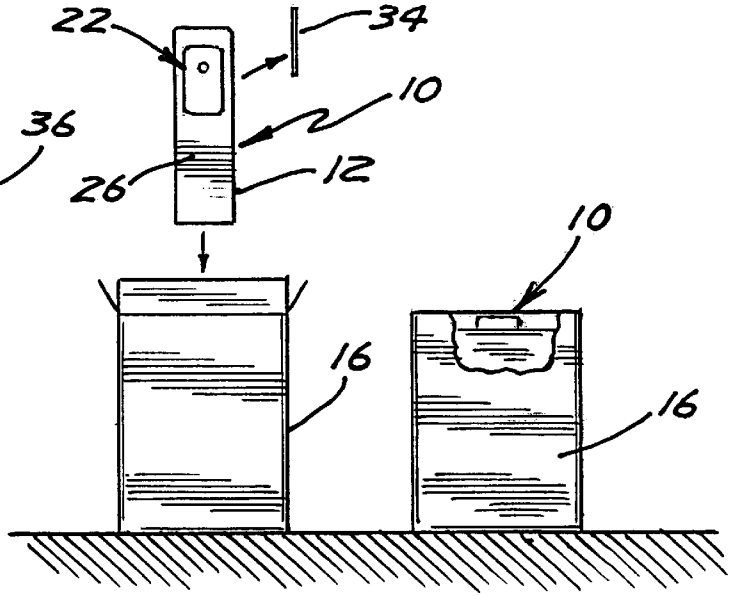
FIG. 2
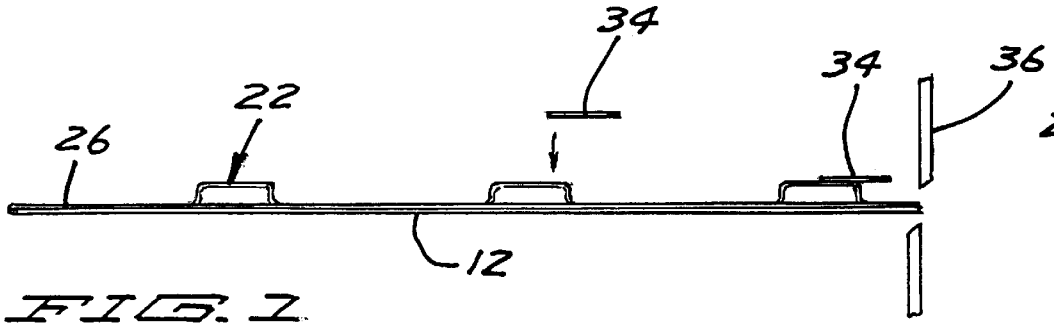
FIG. 7
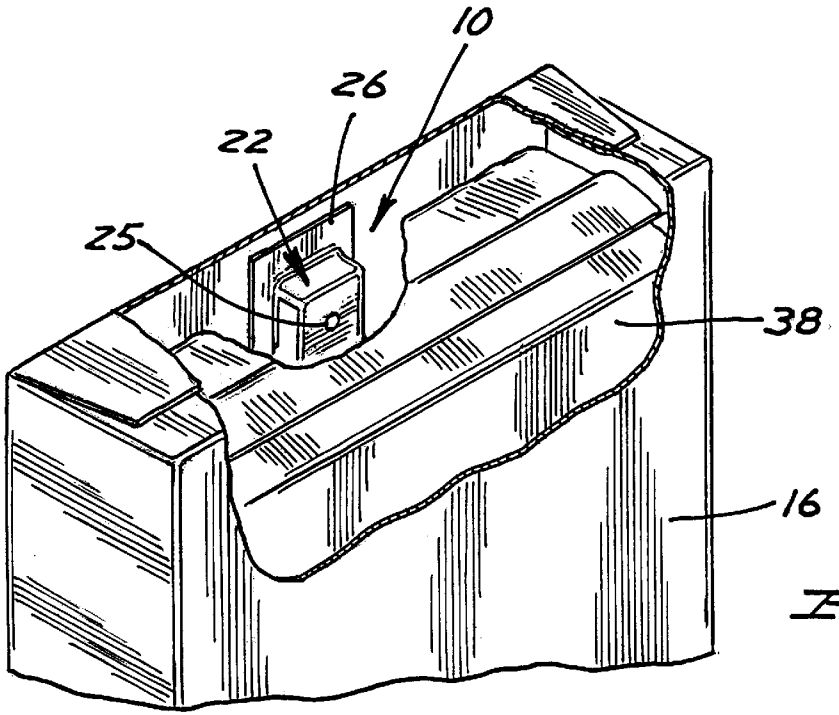

10
34
25
4
23
24
26
18
4

10
34
22
23
24
26
12

10
20
20
12

PRIZE ANNOUNCEMENT ASSEMBLY AND ITS MANUFACTURE

BACKGROUND

The present invention generally relates to assemblies providing a sound when exposed to light and their method of manufacture, specifically relates to assemblies intended to be placed in closed packages and in a preferred form which provide a sound when the package is opened, and particularly in the most preferred form to assemblies which audibly announce the winning of a prize when the package is opened.

Due to the fierce competition in the marketing of breakfast cereals, it is the practice of many cereal manufacturers to include a premium with the cereal to promote the sale of the cereal beyond the marketability of the cereal itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different boxes, cartons, or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

Thus, a need continues to exist for unique marketing techniques for increasing the appeal and desirability of products and which can be economically included with the product and which meet the requirements of promotional devices in the trade.

SUMMARY

Surprisingly, the present invention solves this need and other problems in the field of promotional devices by providing, in the preferred form, a sound-providing device secured to the upper surface of a mounting board by a film formed of translucent material adhered to the upper surface of the mounting board to thereby seal the sound-providing device against contamination and migration while allowing sound to be provided by the sound-providing device when exposed to light. In the preferred form, a plurality of sound-providing assemblies are interconnected as a continuous strip and are cut between the sound-providing devices to form a plurality of individual sound-providing assemblies.

In a preferred aspect, the sound-providing assembly is placed within the interior of a package and in its most preferred form the sound-providing device is not activated in the package while in its closed condition and is activated as soon as the package is opened. In other aspects of the present invention, the sound-providing device is mounted adjacent to one of the longitudinal ends of the mounting board and positioned adjacent the top of a bag by the opposite end of the mounting board being inserted between the bag and the package.

It is thus an object of the present invention to provide a novel assembly for providing a sound in connection with the marketing of products.

It is further an object of the present invention to provide a novel method for manufacturing a sound-providing assembly for use in connection with the marketing of products.

It is further an object of the present invention to provide such a novel sound-providing assembly for increasing the marketability of products beyond the attributes of the product itself.

It is further an object of the present invention to provide such a novel sound-providing assembly which significantly increases the enthusiasm that consumers view products, with all or only some of such products including sound-providing assemblies.

It is further an object of the present invention to provide such a novel sound-providing assembly which can be easily manufactured, handled, and manipulated.

It is further an object of the present invention to provide such a novel sound-providing assembly which can be placed in packages in low tolerance operations.

It is further an object of the present invention to provide such a novel sound-providing assembly which can be utilized, without modification, in packages of differing sizes.

It is further an object of the present invention to provide such a novel sound-providing assembly which is sealed against contamination and migration.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 1 shows a diagrammatic side view showing a method of manufacture of a sound-providing assembly according to the preferred teachings of the present invention.

FIG. 2 shows a perspective view of a package which is partially broken away to show the sound-providing assembly according to the preferred teachings of the present invention.

Figures 3, 4, 5:
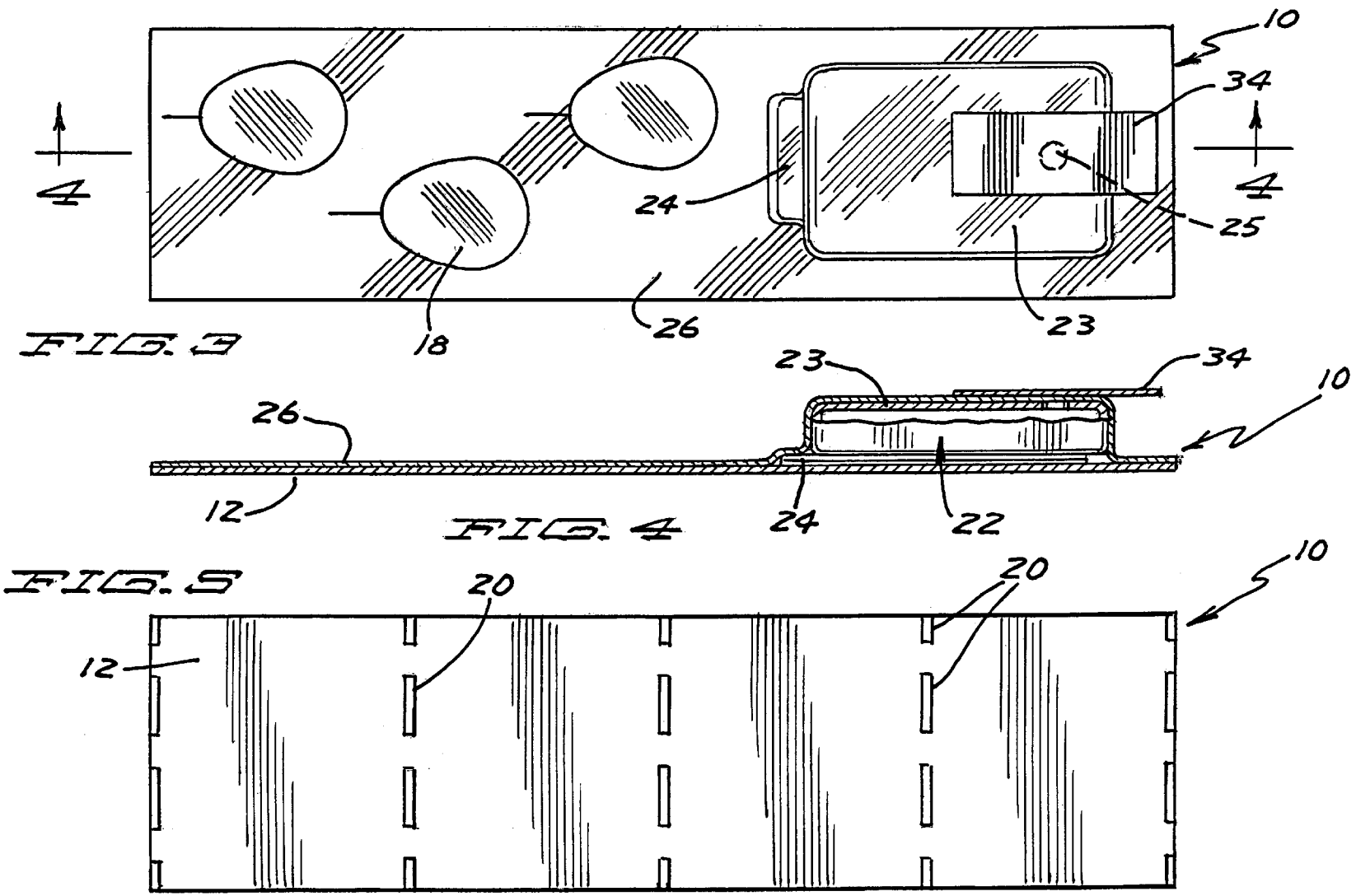
FIG. 3 shows a top plan view of a sound-providing assembly according to the preferred teachings of the present invention.
FIG. 4 shows a cross-sectional view of the sound-providing assembly of FIG. 3 according to section line 4—4 of FIG. 3.
FIG. 5 shows a bottom plan view of the sound-providing assembly of FIG. 3.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "front", "back", "rear", "upper", "lower", "height", "width", "length", "end", "side", "lateral", "longitudinal", and similar terms are used herein, it should be understood that these terms have reference only to the structure shown in the drawings as it would appear to a person viewing the drawings and are utilized only to facilitate describing the illustrative embodiment.

DESCRIPTION

An audible message prize assembly manufactured according to the preferred teachings of the present invention is shown in the drawings and generally designated 10. Specifically, a mounting board 12 is fabricated from an easily cutable stock such as paperboard. In the most preferred form, the upper surface of board 12 includes indicia 18 such as but not limited to graphics and printed material appropriate for assembly 10 in promoting the sale of a package 16 into which assembly 10 is desired to be inserted. Likewise, the lower surface of board 12 can also include indicia 20 such as but not limited to printed lines extending transversely across board 12 for purposes of indicating the longitudinal length of board 12. Alternately, indicia 20 could be in the form of perforation lines extending through board 12.

Assembly 10 further includes a light activated sound-providing device 22. Generally, device 22 has a housing 23 including a flat lower surface and in the most preferred form is of a sufficient size so as to prevent accidentally being ingested by a consumer, particularly a small child. Such embodiments, of course, find particular suitability for use in connection with packages 16 for consumer food items such as breakfast cereal. Device 22 further includes provisions for producing or providing a sound when a light sensor 25 is exposed to light. It should be appreciated that assembly 10 can be used as a toy premium, with the sound provided by device 22 increasing the amusement or play value of assembly 10. For example, housing 23 of device 22 could be fabricated in the shape of a figurine or the like, with light sensor 25 positioned proximate the eyes of the figurine. By covering and uncovering the eyes of the figurine or in other words light sensor 25 of device 22, sound could be produced by device 22 such as a sound in the form of a roar or similar sound appropriate with the shape of housing 23 of device 22. Also, assembly 10 can be used as a prize announcement with device 22 providing a sound in the form of an audible announcement or similar communication that a sweepstakes prize has been won by virtue of purchase of package 16. However, assembly 10 can be used in other manners where device 22 simply functions to get attention to assembly 10, the contents of package 16, or the like.

In the most preferred form, assembly 10 further includes a certificate 24 printed on paper stock. Certificate 24 can be in the form of a coupon for the future purchase of package 16, a printed message such as a prize announcement, the message itself could be the prize, or the like. In the most preferred form, certificate 24 is folded to a size approximating the size of the lower surface of device 22.

Device 22 is placed on the upper surface of board 12 at consistent positions on the longitudinal length of board 12 and with sensor 25 being on the upper surface of device 22 opposite to board 12. In the most preferred form, certificate 24 is also placed on board 12 and preferably intermediate the lower surface of device 22 and the upper surface of board 12.

A film of translucent, thermoplastic material 26, which in the most preferred form is a suryln resin which is currently utilized in a variety of medical and food packaging applications, is adhered to at least the upper surface of board 12 and overlays the upper and edge surfaces of device 22 and any portions of certificate 24 extending beyond the perimeter edges of device 22.

It can be appreciated that certificate 24 and/or device 22 can be adhered in other manners according to the teachings of the present invention. Particularly, conventional bubble pack and blister pack technology may be utilized. Likewise, in some applications, especially for nonfood applications, a simple strip of clear packing tape can be adhered to the upper surface of board 12 and around certificate 24 and device 22 and also can extend over the edges of board 12 and additionally be adhered to the lower surface of board 12. The use of packing tape or the like is advantageous as not requiring the application of heat during the formation of assembly 10.

In commercial practice, a removable, exterior, opaque label 34 is adhered to or otherwise positioned on material 26 in a manner to overlay light sensor 25 of device 22. It can be appreciated that when light sensor 25 of device 22 is exposed to light, device 22 provides a sound. By placing label 34 over light sensor 25, device 22 is not activated even though assembly 10 is exposed to light. Thus, premature exhaustion of the battery or other energy source of device 22 does not occur during handling and manipulation of assembly 10. Similarly, repetitive sound activation from multiple devices 22 during handling and manipulation of a plurality of assemblies 10 would possibly be annoying and undesirable. Also, assembly 10 can be stored or transported in lighted environments for extended periods of time without causing device 22 to be activated.

In the preferred form, a plurality of assemblies 10 are provided as a continuous strip with the leading edge of one assembly 10 being interconnected to the trailing edge of the preceding assembly 10. In the preferred form, assemblies 10 are separated such as by cutting with a suitable cutting mechanism 36 to define first and second, longitudinally spaced ends. Similarly, a plurality of assemblies 10 can be provided with the side edges of assemblies 10 being interconnected, and in the most preferred form with assemblies 10 arranged as an array. In such a form, assemblies 10 are separated such as by cutting with a suitable cutting mechanism to define first and second side edges of assemblies 10. It can be appreciated that labels 34 can be applied before or after assemblies 10 are separated from each other. Additionally, it can be appreciated that assemblies 10 can be stored, transported, or otherwise handled in a separated condition such as in stacks or in a connected condition such as in a roll.

In the preferred form, the longitudinal length between the first and second ends of assembly 10 is typically less than the height of package 16 into which assembly 10 is desired to be inserted and in the preferred form is equal to and preferably less than but in any case not greater than the height of the shortest package 16 into which assembly 10 is desired to be inserted. The longitudinal length between the first and second ends of assembly 10 is a multiple of times greater than the longitudinal extent of device 22. The lateral width between the first and second side edges of assembly 10 is greater than the lateral extent of certificate 24 and/or device 22 on board 12 and in the preferred form is considerably less than the longitudinal length of assembly 10. It can then be appreciated that the area of the upper surface of board 12 of assembly 10 is substantially larger than the area of device 22 to allow viewing of indicia 18 through material 26 and beyond the perimeter of certificate 24 and/or device 22. In the preferred form, device 22 is located adjacent to the first end of board 12 and is spaced from the second end of board 12 so that the second end of board 12 is available to be cut for a particular package 16 into which assembly 10 is desired to be inserted and/or for anchoring assembly 10 inside of package 16.

In the preferred form where assembly 10 is utilized in a prize announcement, attention getting, or similar function, label 34 is removed from assembly 10 before its insertion into package 16. It can be appreciated that label 34 can be removed either before or after assemblies 10 are separated from each other. An individual assembly 10 is then placed in package 16. In the preferred form, a bag 38, including product, is located in the interior of package 16. The top of bag 38 is spaced below or the product contents inside of bag 38 is spaced below the top of package 16 so bag 38 can be compressed to a position below the top of package 16. In the most preferred form, assembly 10 is placed in package 16 by inserting and sliding the second longitudinal end of assembly 10 between bag 38 and package 16 until device 22 is positioned adjacent to the top of bag 38 in a manner as shown in FIG. 2. The first longitudinal end of assembly 10 is located within the interior of package 16 and specifically below the top thereof. In the preferred form, device 22 is positioned sufficiently close to the first longitudinal end so that the lower surface of board 12 of assembly 10 can flushly abut with package 16, that the first, longitudinal end is located at or below the top of package 16, and that at least light sensor 25 of device 22 is positioned adjacent the top of bag 38. It can be appreciated that at least the portion of assembly 10 from the second longitudinal end to generally where device 22 is secured to board 12 is sandwiched between the product contents of bag 38 and package 16 and tends to act as an anchor in generally holding assembly 10 in position in the interior of package 16 and relative to bag 38 and specifically generally prevents and at least severely restricts movement of assembly 10 in the interior of package 16. Although in the most preferred form assembly 10 is placed between bag 38 and one of the major faces of package 16 for ease of insertion, it can be appreciated that assembly 10 can be placed between bag 38 and one of the side faces of package 16 if desired.

After assembly 10 is placed in package 16 in the desired manner, package 16 can then be closed and sealed in a conventional manner. It can be appreciated that when package 16 is in a closed condition preventing passage of light into the interior thereof, assembly 10 is located within the interior thereof and specifically is not exposed to light even though package 16 is in a lighted environment. The individual, sealed packages 16 can be handled and retailed in a conventional manner. However, it can be appreciated that when a consumer opens package 16 in a lighted environment in the normal manner, light is allowed to pass into the interior of package 16 so that assembly 10 therein is exposed to light. Specifically, as device 22 is generally located above the product contents of bag 38, bag 38 does not conform to the shape of device 22 and typically light will be allowed to pass between bag 38 and device 22 or in any case device 22 will be exposed to light after normal manipulation in opening of bag 38 or when assembly 10 is withdrawn from between bag 38 and package 16. Thus, when package 16 is opened, the light is sensed by light sensor 25 of device 22 which is thereby activated to provide a sound such as an audible message. As an example, when assembly 10 is utilized in a prize announcement function, the sound provided by device 22 could be in the form of verbalizing the words "You won" together with the background sounds of cheers, applause, and the like.

Assembly 10 and its method of manufacture is particularly advantageous according to the teachings of the present invention. Specifically, assembly 10 can be easily manufactured, handled, and manipulated mechanically and/or manually in a relatively inexpensive manner by conventional packaging techniques without requiring any folding operations which must be formed manually or by complicated mechanisms. Additionally, boards 12 act as a carrier for devices 22. Boards 12 can be easily handled by conventional handling equipment. Additionally, devices 22 of a variety of shapes, sizes and configurations can be handled by the same handling equipment with no or minimal adjustment. Further, boards 12 act to position devices 22 proximate the top end of package 16 and specifically the relatively large area of board 12 prevents assembly 10 from sinking in package 16 and in the preferred form below the contents of bag 38. Positioning device 22 proximate the top of package 16 is especially important when assembly 10 is utilized in a prize announcement function so that device 22 provides the audible message when package 16 is initially opened by the consumer.

In the preferred form, the length and width of board 12 and thus of assembly 10 is less than the height, length and width of package 16 and in the most preferred form is relatively loose and would be easily movable within package 16 if not sandwiched between bag 38 and package 16. This is particularly advantageous as assembly 10 can be easily inserted in package 16 with low tolerance operation. Additionally, many products are sold in differing sizes of packages 16. As an example, breakfast cereals can be sold in packages 16 of a standard, large, and extra large sizes. According to the teachings of the present invention, assembly 10 is manufactured in a standard size which is able to fit in package 16 of a standard size. Thus, assembly 10 can be inserted into packages 16 of a standard size as well as packages 16 of a larger size such as the large and extra large sizes. Alternately, board 12 and material 26 of assembly 10 of a standard size can be easily cut to fit smaller packages 16 as desired. Indicia 20 is especially desirable for this feature. Additionally, the final selection and size of package 16 can be deferred until well after the manufacture of assemblies 10 according to the preferred teachings of the present invention. Similarly, the same equipment for manufacturing assemblies 10 for insertion in packages 16 for one type of product can be utilized without adjustment to manufacture assemblies 10 for insertion in packages 16 for another type of product but of a different size. Thus, although a discerning consumer might be able to tell that assembly 10 is within a particular package 16 such as the result of movement of assembly 10 within package 16 due to its relatively smaller size, the benefits from the relatively simple and uniform fabrication of assembly 10 according to the teachings of the present invention are believed to overshadow its potential shortcomings.

Assembly 10 according to the teachings of the present invention also seals device 22 against contamination and migration. Specifically, device 22 is enclosed in a sealed enclosure defined by board 12 and material 26, with material 26 being translucent to allow light to pass therethrough to activate light sensor 25 of device 22 which then provides the desired sound. In this regard, device 22 must be spaced sufficiently from the ends and side edges of board 12 such that a sufficient amount of material 26 is adhered to the upper surface of board 12 without gaps or other entrances for communication of air and other environmental elements. Such sealing is advantageous as housing 23 of device 22 may be fabricated from a plastic that may contain plasticizers which might undesirably migrate from device 22 to the contents of package 16 resulting in contamination thereof. This would be highly undesirable for food products as the contamination may adversely affect the flavor or other properties of the food product or otherwise render it unsuitable for consumption. Likewise, dust or other small particles from the interior of package 16 could infiltrate housing 23 of device 22 rendering it inoperative. Thus, material 26, in addition to performing the function of securing certificate 24 and/or device 22 to board 12, provides a sealing function therefor.

In the normal handling of packages 16 for breakfast cereals and the like, packages 16 after being sealed are passed by a metal detector to insure that no metal is present, with it being undesirable for metal to be ingested. According to the preferred teachings of the present invention, assembly 10 is manufactured so as not to be detected by conventional metal detectors. Thus, packages 16 including assembly 10 can be subjected to the normal handling of packages 16 which do not contain assemblies 10 including but not limited to passing by a metal detector. Additionally, when assemblies 10 are only placed in a few of multiple packages 16 such as when performing a prize announcement function, the particular packages 16 which include assemblies 10 can not be determined by passing packages 16 by a metal detector.

The inclusion of premiums, prizes, or the like to increase the marketability of products beyond the attributes of the product itself is a well-known marketing technique. It is believed that the inclusion of devices 22 in packages 16 significantly increases the enthusiasm that consumers will view packages 16 due to the novelty of providing an audible message or similar sound to the consumer. Thus, assembly 10 increases the appeal and desirability of package 16 and the product contained therein to the consumer to maximize the promotional value of assembly 10. Assembly 10 according to the teachings of the present invention provides a viable manner for easily including devices 22 in packages 16 with minor disruption of the normal handling of packages 16 and without requiring packages 16 to be different from packages 16 which are not intended to include assemblies 10. Additionally, assemblies 10 are relatively inexpensive to manufacture and can be manufactured and placed by mechanical means which is less costly in both labor and disruption of normal handling of packages 16. Therefore, assemblies 10 according to the teachings of the present invention provide an enhanced marketing technique for increasing the marketing of products.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Method comprising the steps of: providing a sound-providing assembly including a light-activated, sound-providing device positioned on an upper surface of a mounting board and a film formed of translucent material positioned over the upper surface of the mounting board and over the sound-providing device on the upper surface of the mounting board and adhered to the upper surface of the mounting board to secure the sound-providing device to the mounting board; and positioning a removable opaque label on the film positioned over the sound-providing device after the film is adhered to the upper surface of the mounting board, with the opaque label preventing light from activating the sound-providing device.

2. The method of claim 1 further comprising the steps of: providing a package having an interior, an open condition allowing passage of light into the interior, and a closed condition preventing passage of light into the interior; and placing the sound-providing assembly into the interior of the package while in its open condition and then closing the package into the closed position.

3. The method of claim 2 wherein the sound-providing assembly placing step comprises the step of placing the sound-providing assembly into the interior with the sound-providing device being activated, with the sound-providing device not being activated in the package in the closed condition.

4. The method of claim 2 further comprising the step of: removing the opaque label from the film before the sound-providing assembly is placed into the interior of the package.

5. The method of claim 2 wherein the step of providing the package comprises the step of providing the package including a bag including product, with the bag having a top located in the interior of the package; wherein the sound-providing assembly providing step comprises the step of providing the mounting board having first and second longitudinally spaced ends, with the sound-providing device located adjacent to the first end and spaced from the second end of the mounting board; and wherein the placing step comprises the step of inserting the second end of the mounting board between the bag and the package until the sound-providing device extends adjacent the top of the bag with the first end of the mounting board located within the interior of the package in the closed condition.

6. The method of claim 1 wherein the sound-providing assembly providing step comprises the step of: providing the sound-providing assembly including a certificate intermediate the sound-providing device and the upper surface of the mounting board.

7. The method of claim 1 wherein the sound-providing assembly providing step comprises the step of providing the mounting board in the form of paperboard.

8. The method of claim 1 wherein the sound-providing assembly providing step comprises the steps of: providing a plurality of sound-providing assemblies with their mounting boards and the film adhered thereto being interconnected; and cutting the interconnected mounting boards and the film adhered thereto between the sound-providing devices to form a plurality of individual sound-providing assemblies.

9. An assembly for providing a sound comprising, in combination: a mounting board having first and second, longitudinally spaced ends and an upper surface; a light-activated, sound-providing device; a film formed of translucent material extending over and adhered to the upper surface of the mounting board and extending over the sound-providing device and securing the sound-providing device to the upper surface of the mounting board, with the film sealing the sound-providing device against contamination and migration while allowing sound to be provided by the sound-providing device when exposed to light.

10. The sound-providing assembly of claim 9 further comprising, in combination: a package including an interior and a top having an open condition allowing passage of light into the interior and a closed condition preventing the passage of light into the interior, with the mounting board and the sound-providing device secured thereto by the film being positioned in the interior of the package.

11. The sound-providing assembly of claim 10 wherein the sound-providing device is not activated in the package when the top is in the closed condition and is activated in the package when the top is in the open condition.

12. The sound-providing assembly of claim 10 further comprising, in combination: a removable opaque label positioned on the film and over the sound-providing device, with the opaque label preventing light from activating the sound-providing device.

13. The sound-providing assembly of claim 10 further comprising, in combination: a bag including product and having a top, with the bag located in the interior of the package, with the sound-providing device located adjacent to the first end and spaced from the second end of the mounting board, with the second end of the mounting board being inserted between the bag and the product with the sound-providing device extending above the top of the bag, and with the first end of the mounting board located within the interior of the package when the top of the package is in the closed condition.

14. The sound-providing assembly of claim 9 wherein the film is formed of surylin resin.

15. The sound-providing assembly of claim 9 wherein the mounting board is formed of paperboard.

16. The sound-providing assembly of claim 9 further comprising, in combination: a certificate intermediate the sound-providing device and the upper surface of the mounting board.

17. The sound-providing assembly of claim 9 further comprising, in combination: indicia located on the upper surface of the mounting board, with the area of the upper surface of the mounting board being substantially larger than the area of the sound-providing device to allow viewing of the indicia through the film and past the sound-providing device.

18. The sound-providing assembly of claim 17 wherein the mounting board further includes a lower surface; and wherein the sound-providing assembly further comprises, in combination: means on the lower surface of the mounting board for indicating the longitudinal length of the mounting board between the first and second ends.

19. The sound-providing assembly of claim 9 wherein the mounting board further includes a lower surface; and wherein the sound-providing assembly further comprises, in combination: means on the lower surface of the mounting board for indicating the longitudinal length of the mounting board between the first and second ends.

* * * * *